US009203133B2

(12) United States Patent
Rogers

(10) Patent No.: US 9,203,133 B2
(45) Date of Patent: Dec. 1, 2015

(54) DIRECTIONAL COUPLERS WITH VARIABLE FREQUENCY RESPONSE

(71) Applicant: HARRIS CORPORATION, Melbourne, FL (US)

(72) Inventor: John E. Rogers, Vero Beach, FL (US)

(73) Assignee: Harris Corporation, Melbourne, FL (US)

( * ) Notice: Subject to any disclaimer, the term of this patent is extended or adjusted under 35 U.S.C. 154(b) by 302 days.

(21) Appl. No.: 13/654,554

(22) Filed: Oct. 18, 2012

(65) Prior Publication Data

US 2014/0111285 A1 Apr. 24, 2014

(51) Int. Cl.

| | |
|---|---|
| ***H01P 5/12*** | (2006.01) |
| ***H01P 5/18*** | (2006.01) |
| ***H01P 5/22*** | (2006.01) |
| *H01P 1/15* | (2006.01) |

(52) U.S. Cl.

CPC .. *H01P 5/12* (2013.01); *H01P 5/18* (2013.01); *H01P 5/183* (2013.01); *H01P 5/227* (2013.01); *H01P 1/15* (2013.01)

(58) Field of Classification Search

CPC ..... H01P 5/18; H01P 5/12; H01P 5/16
USPC ..... 333/109–120, 122, 24 R
See application file for complete search history.

(56) References Cited

U.S. PATENT DOCUMENTS

| | | | | |
|---|---|---|---|---|
| 4,670,724 | A | 6/1987 | Riblet et al. | |
| 5,025,264 | A | 6/1991 | Stafford | |
| 6,384,353 | B1 | 5/2002 | Huang et al. | |
| 6,587,021 | B1 | 7/2003 | Streeter | |
| 6,600,395 | B1 | 7/2003 | Handforth et al. | |
| 6,812,718 | B1 | 11/2004 | Chong et al. | |
| 6,822,532 | B2 * | 11/2004 | Kane et al. | 333/116 |
| 7,012,489 | B2 | 3/2006 | Sherrer et al. | |

(Continued)

FOREIGN PATENT DOCUMENTS

| | | | |
|---|---|---|---|
| DE | 102010034525 | A1 | 2/2011 |
| EP | 0849820 | A2 | 6/1998 |

(Continued)

OTHER PUBLICATIONS

Information about Related Patents and Patent Applications, see section 6 of the accompanying Information Disclosure Statement Letter, which concerns Related Patents and Patent Applications, Jan. 17, 2013.

(Continued)

*Primary Examiner* — Benny Lee
*Assistant Examiner* — Albens Dieujuste
(74) *Attorney, Agent, or Firm* — Robert J. Sacco; Carol Thorstad-Forsyth; Fox Rothschild LLP

(57) ABSTRACT

Embodiments of coupler systems (10) include a directional coupler (12), a tuning element (14*a*, 14*b*), and an actuator (16*a*, 16*b*). The coupler (12) is configured to split an input signal into two output signals or, alternatively, to combine two input signals into a single output. The tuning element (14*a*, 14*b*) is a capacitive device that allows the frequency response of the coupler (12) to be varied, so that the coupler (12) can be tuned to a particular frequency or range of frequencies at a given operating condition. The actuator (16*a*, 16*b*) generates a mechanical force that actuates tuning element (14*a*, 14*b*).

24 Claims, 11 Drawing Sheets

(56) References Cited

U.S. PATENT DOCUMENTS

| | | | |
|---|---|---|---|
| 7,026,899 | B2 | 4/2006 | Adams et al. |
| 7,123,119 | B2 | 10/2006 | Pashby et al. |
| 7,126,447 | B2 | 10/2006 | Kawai |
| 7,259,640 | B2 | 8/2007 | Brown et al. |
| 7,898,356 | B2 | 3/2011 | Sherrer et al. |
| 8,354,902 | B2 | 1/2013 | Kawabata et al. |
| 2004/0066338 | A1 | 4/2004 | Chen et al. |
| 2004/0069608 | A1 | 4/2004 | Shimizu et al. |
| 2004/0166603 | A1 | 8/2004 | Carley |
| 2004/0189530 | A1 | 9/2004 | Chung et al. |
| 2005/0001701 | A1 | 1/2005 | Shirakawa |
| 2005/0067292 | A1 | 3/2005 | Thompson et al. |
| 2005/0073380 | A1 | 4/2005 | Howell et al. |
| 2005/0116788 | A1* | 6/2005 | Matters-Kammerer et al. ..... 333/116 |
| 2005/0161753 | A1 | 7/2005 | Huff et al. |
| 2005/0190019 | A1 | 9/2005 | Metz |
| 2007/0018761 | A1 | 1/2007 | Yamanaka et al. |
| 2008/0142347 | A1 | 6/2008 | Lewis et al. |
| 2008/0164542 | A1 | 7/2008 | Yang et al. |
| 2010/0277259 | A1 | 11/2010 | Ahn et al. |
| 2011/0220472 | A1 | 9/2011 | Masuda et al. |
| 2012/0175715 | A1 | 7/2012 | Hammond et al. |
| 2013/0140165 | A1 | 6/2013 | Lin et al. |

FOREIGN PATENT DOCUMENTS

| | | | |
|---|---|---|---|
| EP | 1515390 | A1 | 3/2005 |
| EP | 1713144 | A1 | 10/2006 |
| EP | 1939974 | A1 | 7/2008 |
| EP | 2546920 | A1 | 1/2013 |
| ES | 2191642 | | 9/2003 |
| WO | 03/049514 | A2 | 6/2003 |
| WO | 2004/079795 | A2 | 9/2004 |
| WO | 2011/111274 | A1 | 9/2011 |

OTHER PUBLICATIONS

International Search Report and Written Opinion dated Dec. 20, 2013 issued in International Appln. No. PCT/US2013/056368 (12 pages).

Lau, N.U.and Sloan, R., Suspended Microstrip Patch Antenna With Ground-shield Tapered Suspended Stripline Feed, 33rd European Microwave Conference, Munich 2003, 1385-1387.

International Search Report and Written Opinion dated Jan. 16, 2014 issued in International Appln. No. PCT/US2013/06443 (12 pages).

International Search Report and Written Opinion mailed Nov. 28, 2013 for Interational Patent Appln. No. PCT/US2013/056316 to Harris Corporation (11 pages).

International Search Report and Written Opinion mailed Jan. 31, 2014 in International Patent Appln. No. PCT/US2013/065405 to Harris Corporation (9 pages).

International Preliminary Report on Patentability dated Mar. 24, 2015 issued in International Appln. No. PCT/US2013/060814 (8 pages).

International Preliminary Report on Patentability dated Mar. 24, 2015 issued in International Appln. No. PCT/US2013/060817 (8 pages).

International Preliminary Report on Patentability dated Apr. 30, 2015 issued in International Appln. No. PCT/US2013/085405 (6 pages).

* cited by examiner

DIRECTIONAL COUPLERS WITH VARIABLE FREQUENCY RESPONSE

BACKGROUND OF THE INVENTION

1. Statement of the Technical Field

The inventive arrangements relate to directional couplers for dividing or splitting an input signal into multiple outputs, or combining multiple input signals into a single output.

2. Description of Related Art

Directional couplers are commonly used in various telecommunications-related applications such as power dividing and combining; combining feeds to and from antennas; antenna beam forming; phase shifting; etc. Commercially available directional couplers are usually categorized as either waveguide-based or thin-film-based. Typical waveguide-based couplers have relatively high power-handling capacity, but possess a relatively large dimensional footprint. Typical thin-film-based couplers have a relatively small dimensional footprint, but possess relatively low power-handling capacity.

The frequency response of directional couplers is usually fixed, e.g., the frequency (or frequency band) at which maximum power transfer will occur cannot be varied. Thus, the performance of such a coupler cannot be optimized or tuned for multiple operating conditions.

Three-dimensional microstructures can be formed by utilizing sequential build processes. For example, U.S. Pat. Nos. 7,012,489 and 7,898,356 describe methods for fabricating coaxial waveguide microstructures. These processes provide an alternative to traditional thinfilm technology, but also present new design challenges pertaining to their effective utilization for advantageous implementation of various devices such as miniaturized switches.

SUMMARY OF THE INVENTION

Embodiments of coupler systems include a coupler comprising an electrical conductor and a tuning element. The tuning element has an electrically-conductive first portion in electrical contact with the electrical conductor of the coupler and having a first end face, and an electrically-conductive second portion having a second end face. The tuning element also includes a dielectric element disposed on the first or the second end face, and is spaced apart from the other of the first and second end face by a gap. The second portion is configured to move in relation to the first portion so that the gap is variable.

In accordance with further aspects of the inventive concepts disclosed and claimed herein, embodiments of systems include a coupler comprising an electrically-conductive housing and an electrical conductor. The electrical conductor is suspended within the housing on a plurality of dielectric tabs and is spaced apart from the housing. The coupler systems also include a capacitive element configured to vary the frequency response of the coupler.

In accordance with further aspects of the inventive concepts disclosed and claimed herein, embodiments of systems include a coupler having an electrical conductor that forms a signal path, a capacitive element configured to introduce a reactance in the signal path, and an actuator element operative to vary a capacitance of the capacitive element.

BRIEF DESCRIPTION OF THE DRAWINGS

Embodiments will be described with reference to the following drawing figures, in which like numerals represent like items throughout the figures and in which.

DETAILED DESCRIPTION

Figure 1:
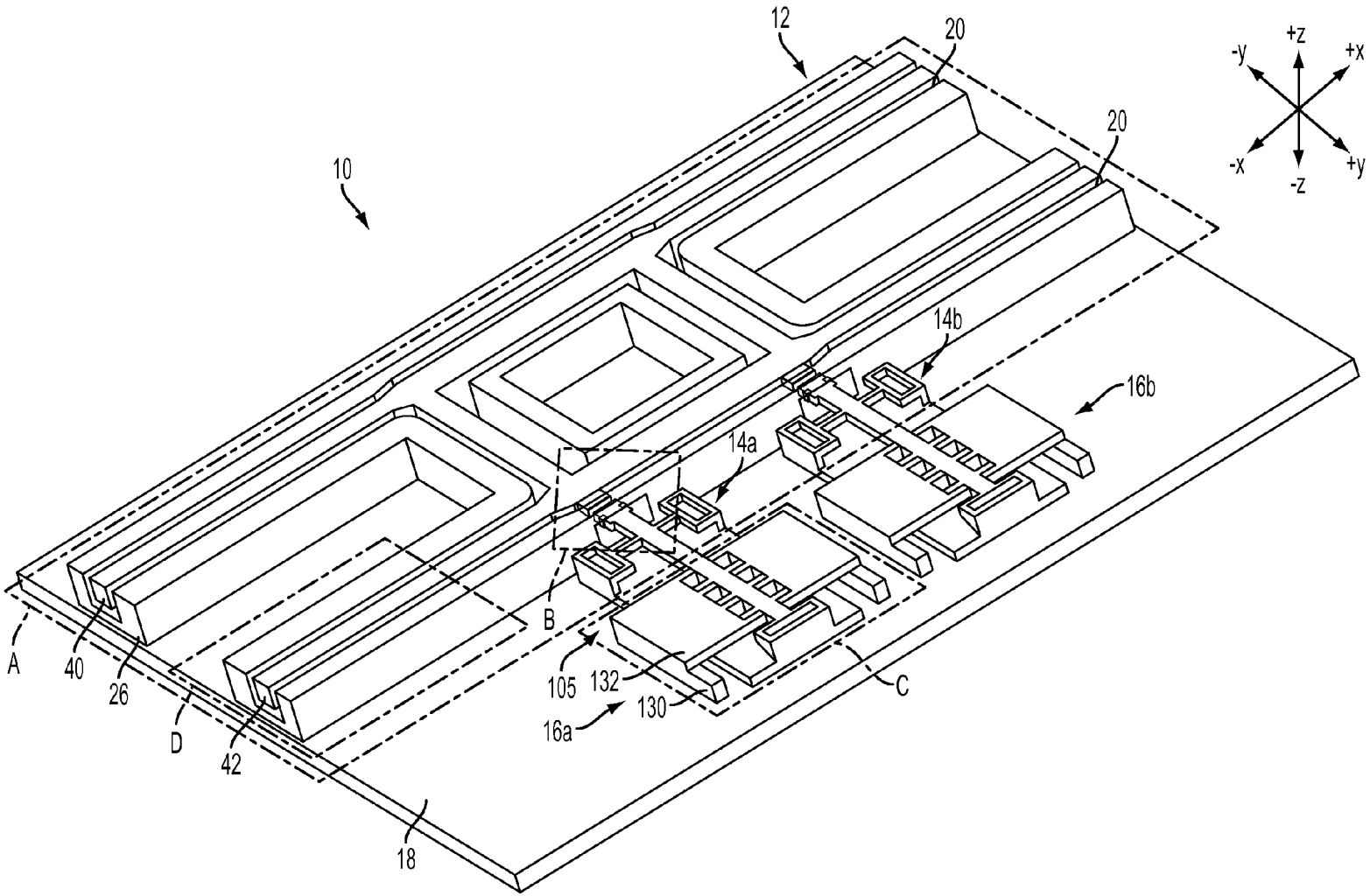
FIG. 1 is a top perspective view of the coupler system shown in FIG. 1, depicting the shuttles in a first or un-deflected position, and with a top layer of the system removed for illustrative purposes.

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

FIGS. 1-8 depict a tunable coupler system 10. The coupler system 10 comprises a 90° hybrid coupler 12, a first and a second tuning element 14*a*, 14*b*, and a first and a second actuator 16*a*, 16*b* each associated with a respective one of the tuning elements 14*a*, 14*b*.

The coupler 12 is configured to split an input signal into two output signals that are equal in power, and differ in phase by 90°. The coupler 12 can also combine two input signals into a single output. Although the coupler 12 is described herein as functioning as a signal splitter, the inventive concepts disclosed and claimed herein can be applied equally to coupler systems in which the coupler 12 functions as a combiner. Moreover, alternative embodiments of the system 10 can include other types of couplers, such as hybrid ring couplers.

The tuning elements 14*a*, 14*b*, as discussed below, are capacitive devices that allow the frequency response of the coupler 12 to be varied. This feature permits the response of the coupler 12 to be tuned to a particular frequency or range of frequencies at a given operating condition. The first and second actuators 16*a*, 16*b* generate mechanical forces that actuate the respective first and second tuning elements 14*a*, 14*b*.

The coupler system 10 has a maximum height ("z" dimension) of approximately 0.5 mm; a maximum width ("y" dimension) of approximately 5.6 mm; and a maximum length ("x" dimension) of approximately 6.9 mm. The coupler system 10 is described as having these particular dimensions for exemplary purposes only. Alternative embodiments of the coupler system 10 can be scaled up or down in accordance with the requirements of a particular application, including size, weight, and power (SWaP) requirements.

The coupler system 10 further comprises a substrate 18, as shown in FIG. 1. The substrate 18 is formed from high-electrical-resistivity aluminum nitrate (AlN). The substrate 18 can also be formed from other dielectric materials, such as silicon (Si), glass, silicon-germanium (SiGe), or gallium arsenide (GaAs) in alternative embodiments. The substrate 18 can have a thickness, i.e., "z" dimension, of approximately 0.5 mm.

Figure 2:
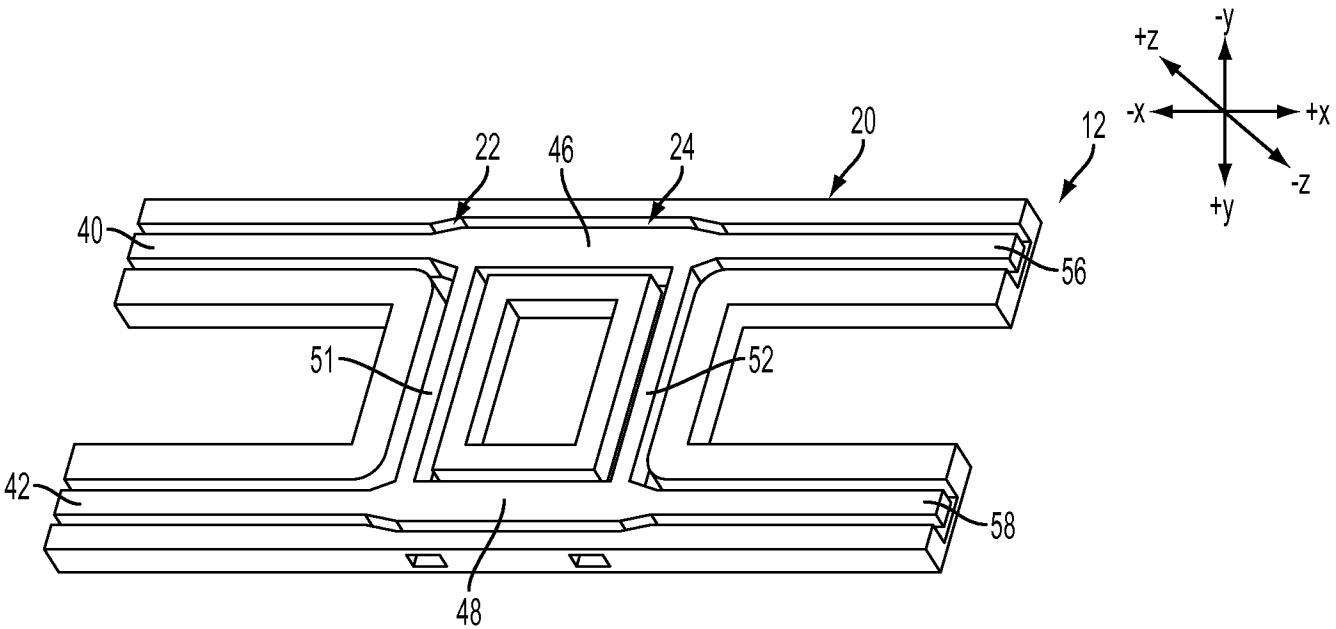
FIG. 2 is a top perspective view of the area designated "A" in FIG. 1, with the top layer of the system removed for illustrative purposes.

The coupler 12 comprises a ground housing 20 disposed on the substrate 18, and an electrical conductor 22. The electrical conductor 22 is accommodated by a series of channels 24 formed in the ground housing 20, as illustrated in FIGS. 2 and 4.

The ground housing 20 is formed from five layers of an electrically-conductive material such as copper (Cu). Each layer can have a thickness of, for example, approximately 50 μm. The number of layers of the electrically-conductive material is application-dependent, and can vary with factors such as the complexity of the design, hybrid or monolithic integration of other devices with the system 10, the overall height ("z" dimension) of the coupler 12, the thickness of each layer, etc.

Figure 4:
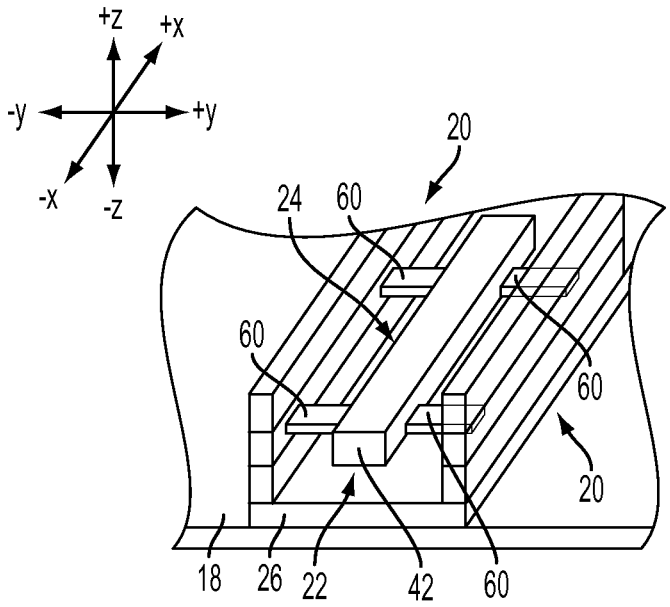
FIG. 4 is a magnified view of the area designated "D" in FIG. 1, with the top layer of the coupler removed for illustrative purposes.

The first layer of electrically-conductive material is disposed directly on the substrate 18, as shown in FIGS. 1 and 4. A portion of the first layer forms the bottom of the ground housing 20, and defines the bottom of each of the channels 24, as illustrated in FIG. 2. Other portions of the first layer form portions of the respective first and second actuators 16*a*, 16*b*. The portions of the first layer that form parts of the ground housing 20 and the first and second actuators 16*a*, 16*b* are electrically connected to ground or to a reference-voltage source (not shown), and collectively function as a ground plane 26.

The sides of the ground housing are formed by the second, third, and fourth layers of electrically-conductive material. The fifth layer of electrically-conductive material forms the top of the ground housing 20.

Figure 3:
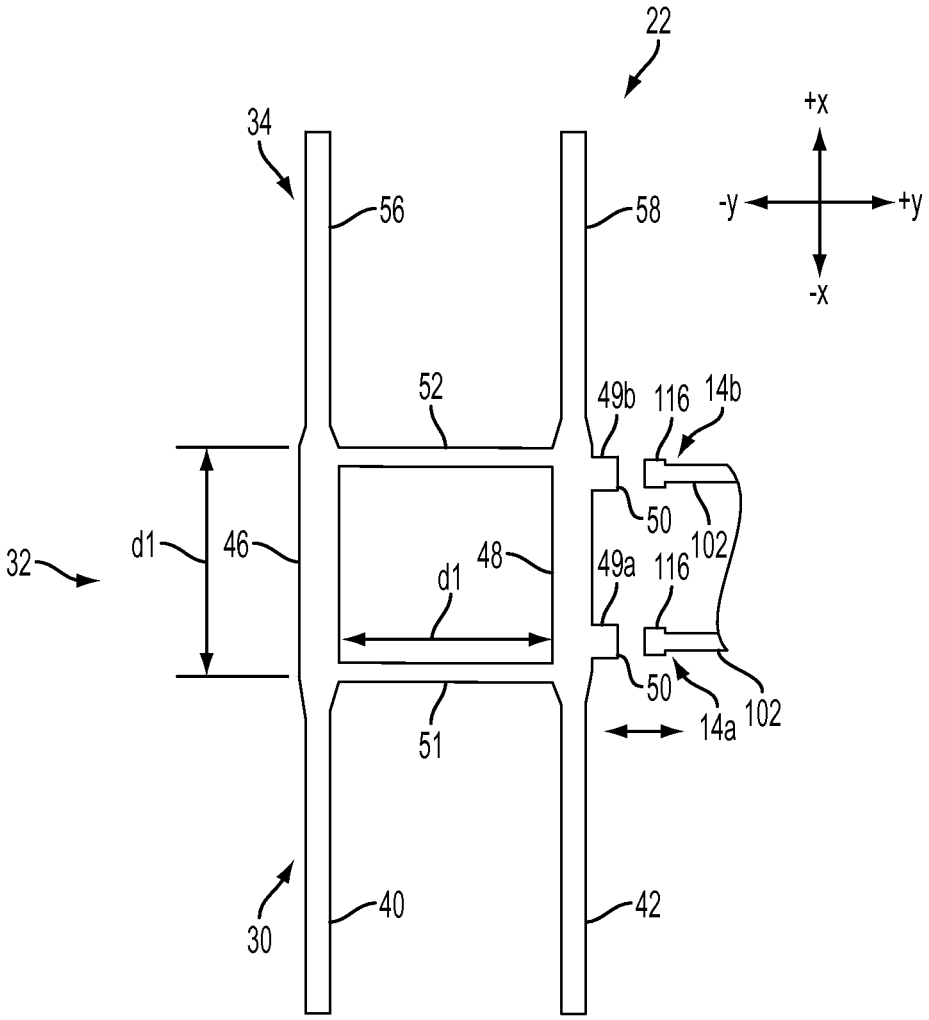
FIG. 3 is a top view of an electrical conductor of the coupler shown in FIGS. 1-2.

The electrical conductor 22 is formed by a portion of the third layer of electrically-conductive material, and has a substantially rectangular cross section as illustrated in FIG. 4. The electrical conductor 22 has an input portion 30, an intermediate portion 32, and an output portion 34, as can be seen in FIG. 3.

The input portion 30 of the electrical conductor 22 includes a first leg 40 and a substantially identical second leg 42. The first and second legs 40, 42 are substantially parallel, and extend substantially in the direction of signal propagation, i.e., in the "x" direction. The first and second legs 40, 42 each have a width, or "y" dimension, that is selected so that the characteristic impedance ($Z_o$) of each of the first and second legs 40, 42 matches a desired value, i.e., 50 ohms, at a reference frequency.

The intermediate portion 32 includes a first leg 46 and a substantially identical second leg 48. The first leg 46 adjoins the first leg 40 of the input portion 30, and the second leg 48 adjoins the second leg 42 of the input portion 30. The first and second legs 46, 48 are substantially parallel, and extend substantially in the "x" direction. The first and second legs 46, 48 each have a length denoted by the reference character "$d_1$" in FIG. 3. The distance $d_1$ is approximately equal to one-quarter of the wavelength of a signal having a reference frequency $f_0$. The reference frequency $f_0$ can be, for example, the desired center frequency about which the coupler 12 can be tuned, as discussed below. The first and second legs 46, 48 each have a width, or "y" dimension, that is greater than the respective widths of the first and second legs 40, 42 of the input portion 30, so that the impedance of each of the first and second legs 46, 48 is approximately equal to $Z_o/\sqrt{2}$ at the reference frequency $f_0$.

First and second projections 49*a*, 49*b* are formed on the second leg 48 of the intermediate portion 32 thereon, as shown in FIGS. 3 and 5-6B. The first projection 49*a* is located proximate a first end of the second leg 48. The second projection 49*b* is located proximate a second end of the second leg 48. The first and second projections 49*a*, 49*b* form part of the respective first and second tuning elements 14*a*, 14*b*.

Each of the first and second tuning elements 14*a*, 14*b* further comprises a thin-film dielectric element 50, as illustrated in FIGS. 3 and 5-6B. The dielectric elements 50 are fixed to the respective end faces of the first and second projections 49*a*, 49*b*, by a suitable means such as adhesive. Each dielectric element 50 can have a thickness of, for example, 20 um. The dielectric elements 50 can be formed, for example, from polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the system 10, as discussed below.

The intermediate portion 32 also includes a third leg 51 and a substantially identical fourth leg 52, as shown in FIGS. 2 and 3. The third and fourth legs 51, 52 are substantially parallel, and each extend substantially in a transverse or "y" direction that is perpendicular to the "x" direction. Opposing ends of the third leg 51 adjoin the respective first and second legs 46, 48, at locations proximate a first end of each of the first and second legs 46, 48. Opposing ends of the fourth leg 52 adjoin the respective first and second legs 46, 48, at locations proximate a second end of each of the first and second legs 46, 48.

The length of each of the third and fourth legs 51, 52 is approximately equal to the distance "$d_1$," as shown in FIG. 3. The width, or "x" dimension of the third and fourth legs 51, 52 is chosen so that the impedance of the third and fourth legs 51, 52 is approximately equal to $Z_o$ at the reference frequency $f_0$.

The output portion 34 includes a first leg 56 and second leg 58, as can be seen in FIGS. 2 and 3. The first and second legs 56, 58 are substantially identical to the first and second legs 40, 42 of the input portion 30. The first leg 56 adjoins the first leg 46 of the intermediate portion 32, and the second leg 58 adjoins the second leg 48 of the intermediate portion 32. The first and second legs 56, 58 are substantially parallel, and extend substantially in the "x" direction. The first and second legs 56, 58 are spaced apart by a distance approximately equal to the distance "$d_1$."

The electrical conductor 22 is suspended within the channels 24 by a plurality of electrically-insulative tabs 60, as illustrated in FIG. 4. The tabs 60 are formed from a dielectric material. For example, the tabs 60 can be formed from polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the system 10, as discussed below.

The tabs 60 can each have a thickness of, for example, approximately 15 μm. Each tab 60 spans the width, i.e., y-direction dimension, of the channel 30, as can be seen in FIG. 4. The ends of each tab 60 are sandwiched between the second and third layers of electrically-conductive material.

The respective widths, e.g., "x" or "y" dimensions, and the height, e.g., "z" dimension, of the channels 24 are selected so that the electrical conductor 22 is surrounded by, and is spaced apart from the interior surfaces of the ground housing 20 by an air gap, as shown in FIG. 4. The air gap acts as a dielectric that electrically isolates the electrical conductor 22 from the ground housing 20. The type of transmission-line configuration is commonly referred to as a "recta-coax" configuration, otherwise known as micro-coax.

Because the coupler 12 is configured as a 90° hybrid coupler, the power of a signal applied to the first leg 40 (or, alternatively, the second leg 42) of the input portion 30 is split evenly between the first and second legs 56, 58 of the output portion 34, and the signals in the first and second legs 56, 58 of the output portion 34 are 90° out of phase. Also, the second leg 42 (or, alternatively, the first leg 40) of the input portion 30 is isolated from the input signal.

The first and second actuators 16*a*, 16*b* are substantially identical. The following description of the first actuator 16*a*, unless otherwise indicated, applies equally to the second actuator 16*b*.

Figure 6A:
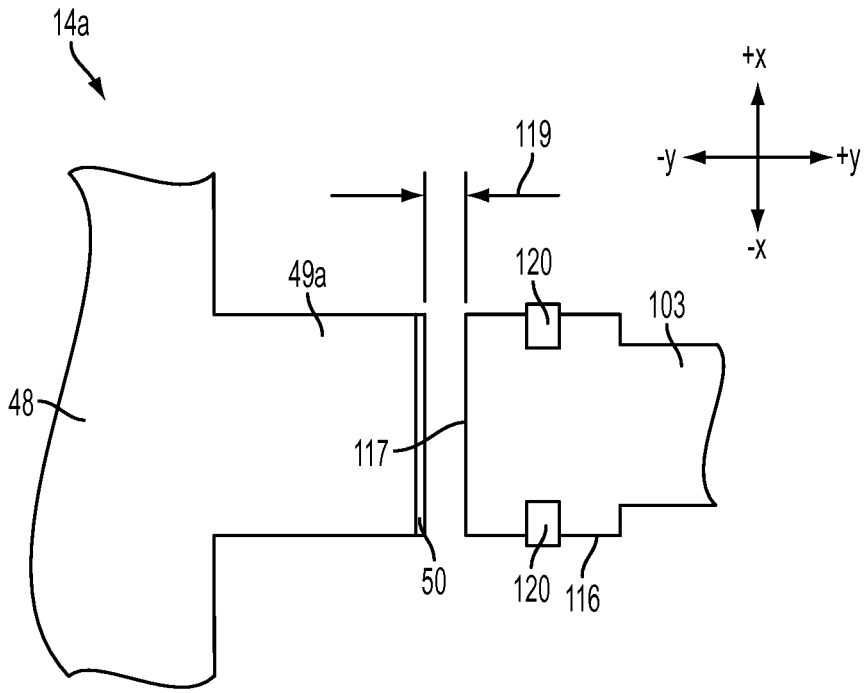
FIG. 6A is a magnified view of the area designated "E" in FIG. 5, depicting the shuttle and the movable portion of the tuning element in their respective un-deflected positions.
Figure 7:
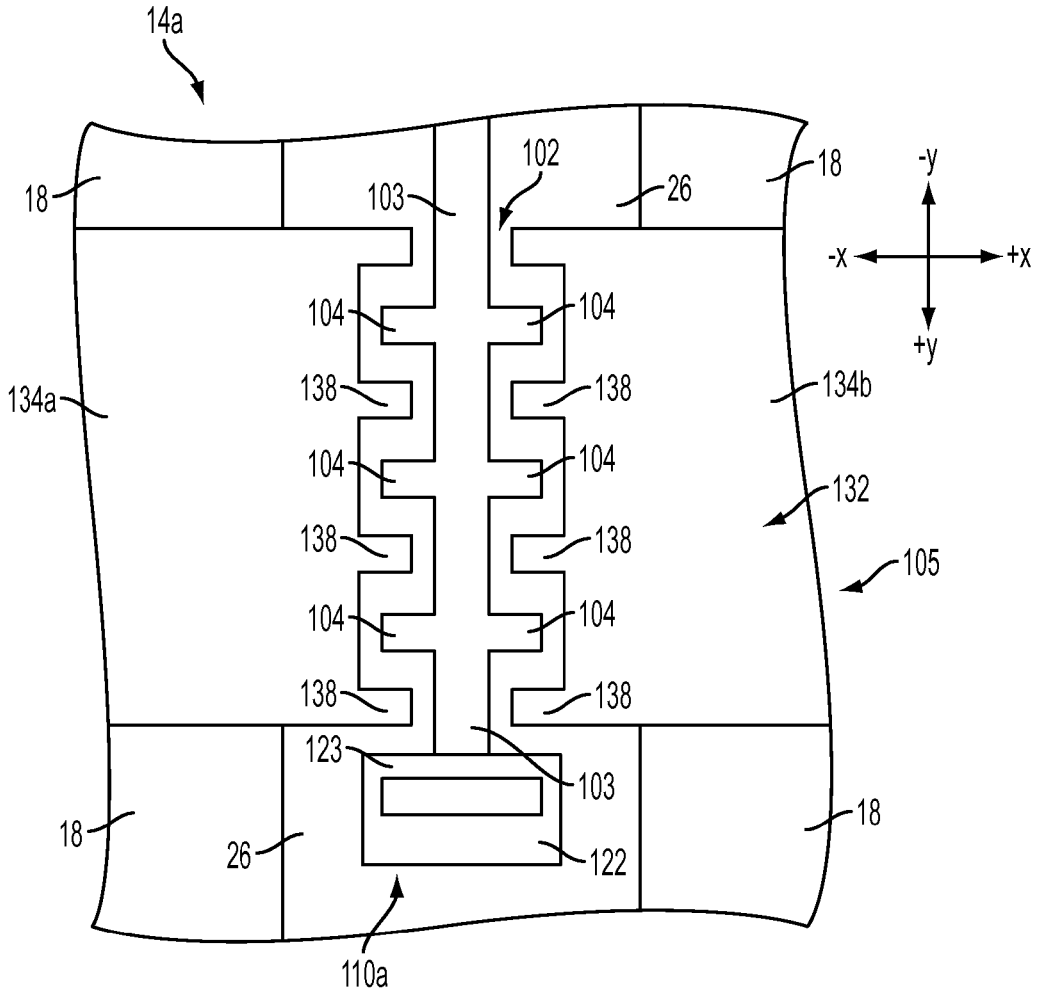
FIG. 7 is a top magnified view of the area designated "C" in FIG. 1, depicting one of the shuttles in its un-deflected position.
Figure 8:
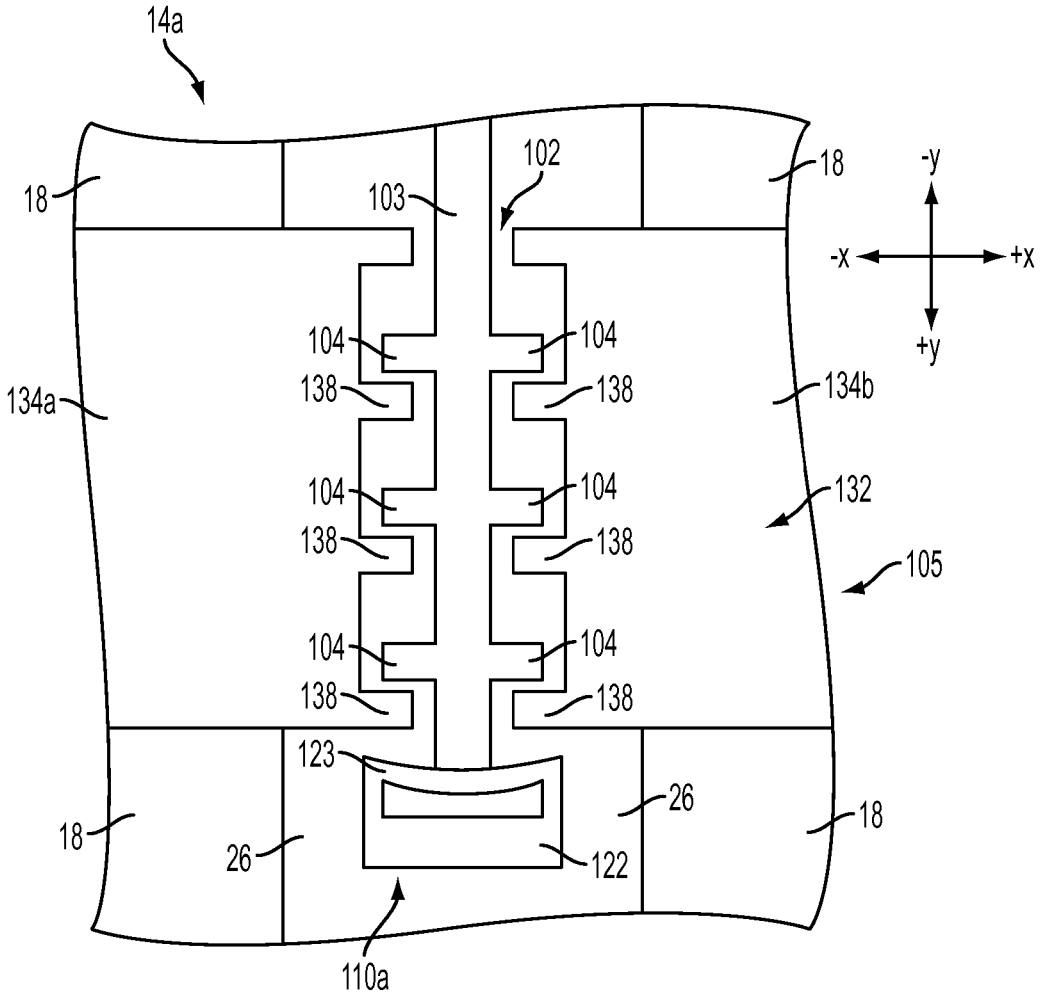
FIG. 8 is a top magnified view of the area designated "C" in FIG. 1, depicting one of the shuttles in its deflected position.

The first actuator 16*a* includes a shuttle 102, a control portion 105, a first lead 106*a*, a second lead 106*b*, and a portion of the ground plane 26, as can be seen in FIGS. 1 and 8. The first actuator 16*a* also includes a first mount 110*a*, a second mount 110*b*, and a third mount 110*c*. The shuttle 102 is configured to move in the "y" direction, between a first of un-deflected position shown in FIGS. 1, 5, 6A, and 7; and a second or deflected position shown in FIGS. 6B and 8.

The shuttle 102 is formed as part of the third layer of electrically-conductive material. The shuttle 102 has an elongated body 103 that extends substantially in the "y" direction, as shown in FIGS. 1, 7 and 8. The shuttle 102 also includes six projections in the form of fingers 104 that extend substantially in the "x" direction as illustrated in FIGS. 7 and 8. Three of the fingers 104 adjoin a first side of the body 103, and the other three fingers 104 adjoin the other side of the body 103.

Figure 5:
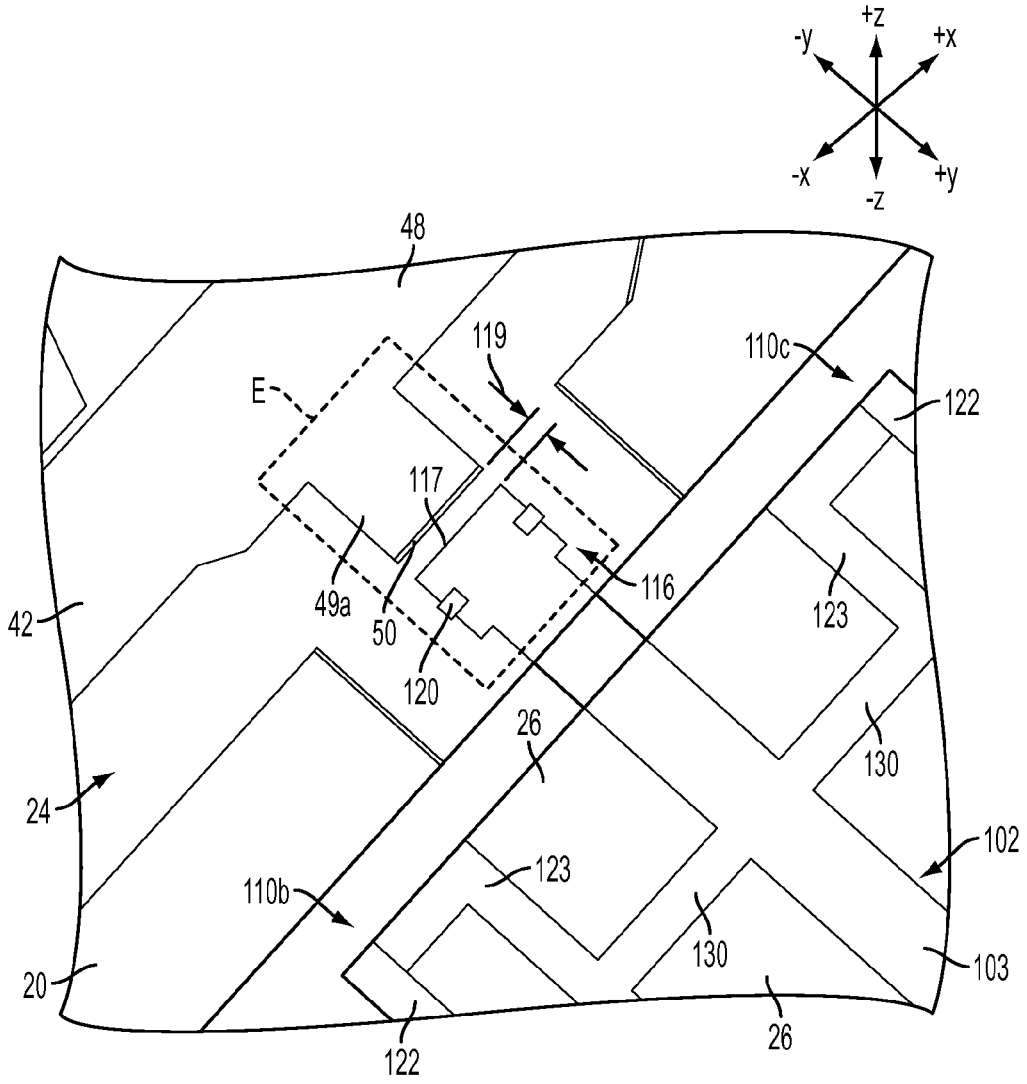
FIG. 5 is a magnified view of the area designated "B" in FIG. 1, with the top layer of the coupler and a top layer of the first actuator removed for illustrative purposes, and depicting one of the shuttles and a movable portion of one of the tuning elements of the system in their respective first or un-deflected positions.
Figure 6B:
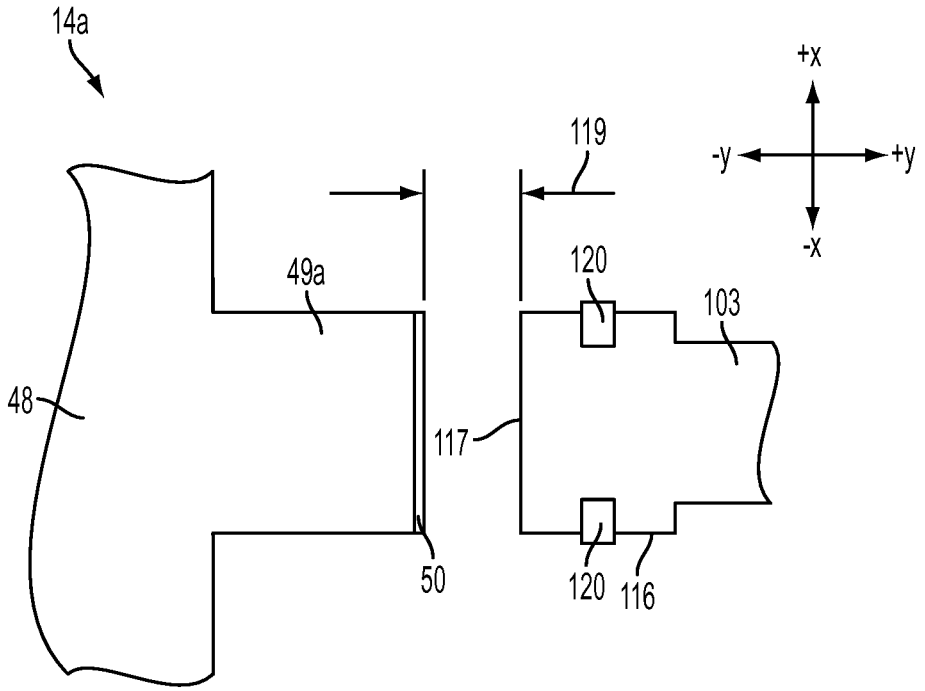
FIG. 6B is a magnified view of the area designated "E" in FIG. 5, depicting the shuttle and the movable portion of the tuning element in their respective second or deflected positions.

The first tuning element 14*a* further comprises a movable portion 116 that adjoins an end of the body 103 of the shuttle 102, as depicted in FIGS. 5-6B. An end face 117 of the movable portion 116 faces the dielectric element 50, and is spaced apart from the dielectric element 50 by a gap 119. The magnitude of the gap 119 is exaggerated in the figures, for clarity of illustration. The end face 117 has a size and shape that substantially match those of the exposed major surface of the dielectric element 50. As discussed below, the shuttle 102 is movable so as to vary the gap 119. Although the dielectric element 50 is described herein as being mounted on the end face of the projection 49*a*, the dielectric element 50 can be mounted on the end face 117 of the movable portion 116 in alternative embodiments.

The first tuning element 14*a* also includes two posts 120 that extend upwardly from the ground plane 26, as shown in FIGS. 5-6B. The posts 120 are formed as part of the second and fourth layers of electrically-conductive material. The posts 120 thus exert a restraining effect on the movable portion 116 in the "x", "y", and "z" directions. Alternative embodiments of the system 10 can be constructed without the posts 120.

The shuttle 102 is suspended from the first, second, and third mounts 110*a*, 110*b*, 110*c*, as illustrated in FIGS. 1, 5, 7, and 8. The first mount 110*a* includes a base 122 that adjoins the ground plane 26, and a beam portion 123 that adjoins the base 122. The base 122 is formed as part of the second and third layers of electrically-conductive material. The beam portion 123 is formed as part of the third layer of electrically-conductive material. An end of the body 103 of the shuttle 102 adjoins the beam portion 123 of the first mount 110*a*, as depicted in FIGS. 1, and 7.

It should be noted that the configuration of the beam portions 123 is application-dependent, and can vary with factors such as the amount of space available to accommodate the beam portions 123, the required or desired spring constant of the beam portions 123, etc. Accordingly, the configuration of the beam portions 123 is not limited to that depicted in the figures.

The second and third mounts 110*b*, 110*c* are substantially identical to the first mount 110*a*, with the following exception. The second and third mounts 110*b*, 110*c* each include an arm 130 having a first end that adjoins the beam portion 123, as illustrated in FIGS. 1, and 5. Respective second ends of the arms 130 adjoin opposite sides of the body 103 of the shuttle 102, proximate a second end of the body 103. The second and third mounts 110*b*, 110*c* are oriented so that the respective angular orientations thereof are offset from that of the first mount 110*a* by approximately 90°. The respective beam portions 120 of the second and third mounts 110*b*, 110*c* thus extend substantially in the "y" direction.

Figure 9:
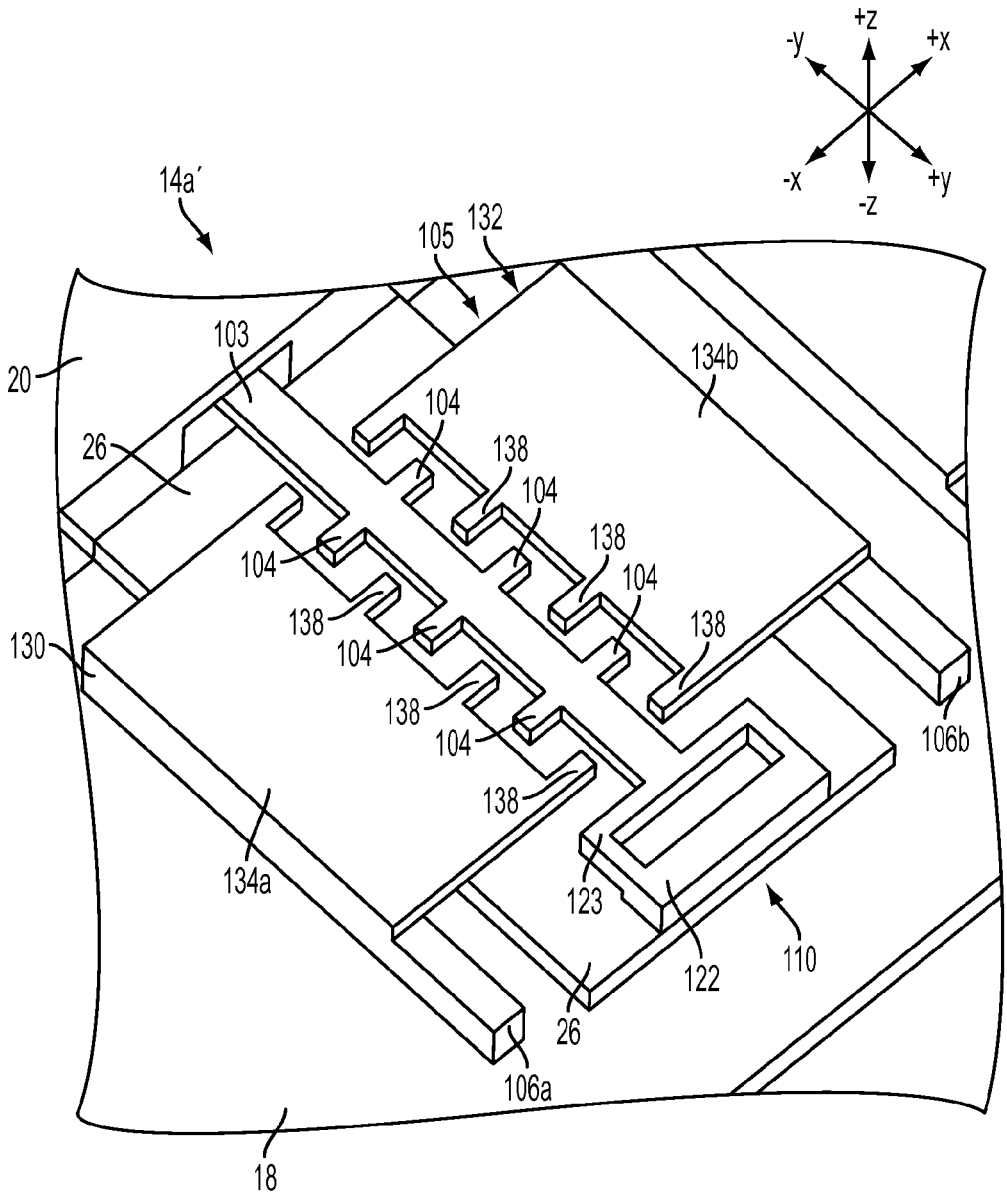
FIG. 9 is a view of an alternative embodiment of the system shown in FIGS. 1-8, depicting an area corresponding to the area designated "C" in FIG. 1, and depicting one of the shuttles in un-deflected position.
Figure 10:
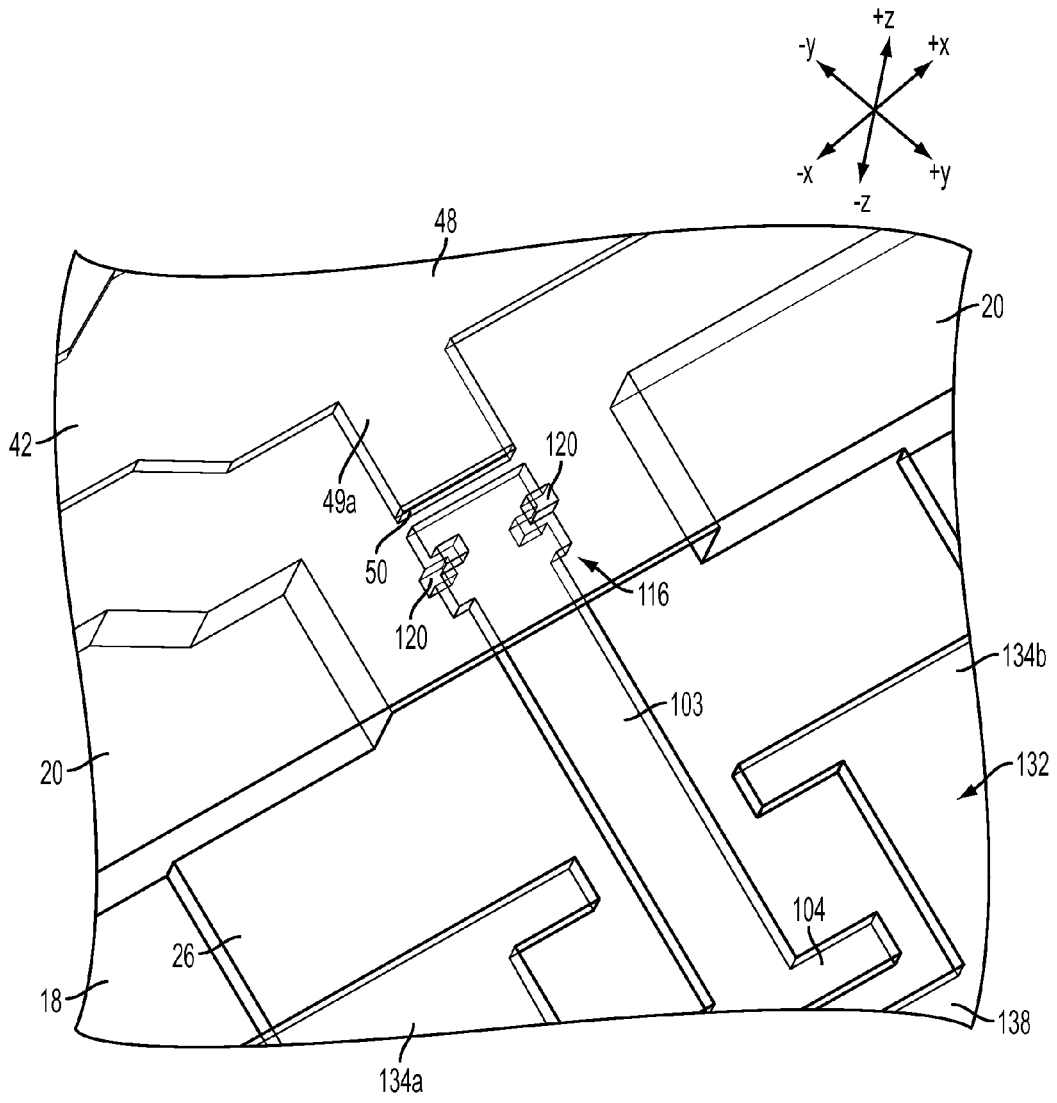
FIG. 10 is another view of the alternative embodiment in FIG. 9, taken from the perspective of FIG. 5 and depicting the shuttle and the movable portion of the tuning element in their respective un-deflected positions.

Alternative embodiments can be constructed without the second and third mounts 110*b*, 110*c*, as depicted in FIGS. 9 and 10. In the embodiment of FIGS. 9 and 10, substantially all of the vertical (z-direction) support for the movable portion 116 of the first tuning element 14*a* is provided by the posts 120.

The control portion 105 of the first actuator 16*a* includes two legs 130, and an adjoining top portion 132, as depicted in FIGS. 1, 7, and 8. The legs 130 are formed as part of the first and second layers of electrically-conductive material. The top portion 132 is formed as part of the third layer of electrically-conductive material. The legs 130 are disposed on the substrate 18, on opposite sides of the ground plane 26 as shown in FIGS. 1, and 7. The control portion 105 thus straddles the ground plane 26, and is not in mechanical or electrical contact with the ground plane 26.

The top portion 132 of the control portion 105 includes a first half 134*a* and a second half 134*b*, as depicted in FIGS. 1, 7, and 8. The first half 134*a* is associated with one of the legs 130, and the second half 134*b* is associated with the other leg 130. The first and second halves 134*a*, 134*b* are positioned on opposite sides of the body 103 of the shuttle 102. The first and second halves 134*a*, 134*b* each include three projections in the form of fingers 138 that extend substantially in the "x" direction. The optimal number of fingers 138 is application-dependent, and can vary with factors such as the amount of force that is needed to move the shuttle 102 to its second, or deflected position.

The shuttle 102 and the first and second halves 134*a*, 134*b* of the control portion 105 are configured so that the fingers 138 of the first and second halves 134*a*, 134*b* and the fingers 104 of the shuttle 102 are interleaved or interdigitated, i.e., the fingers 138, 104 are arranged in an alternating fashion along the "y" direction, as illustrated in FIGS. 1, 7, and 8. Moreover, each of the fingers 104 is positioned proximate an associated one of the fingers 138, and is separated from the associated finger 138 by a gap of, for example, approximately 50 μm when the shuttle 102 is in its first, of un-deflected position.

The first and second leads 106*a*, 106*b* of the first actuator 16*a* are disposed on the substrate 18 as shown in FIGS. 1 and 7, and are formed as part of the first layer of the electrically conductive material. The first lead 106*a* adjoins the leg 130 associated with the first half 134*a* of the top portion 132 of the control portion 105. The second lead 106*b* adjoins the leg 130 associated with the second half 134*b* of the top portion 132. The first and second leads 106*a*, 106*b* can be electrically connected to a voltage source, such as a 120-volt direct current (DC) voltage source (not shown). Because the first and second halves 134*a*, 134*b* of the top portion 132 are in contact with their associated legs 130, energization of the first and second leads 106*a*, 106*b* results in energization of the first and second halves 134*a*, 134*b*, including the fingers 138.

The first actuator 16*a* is configured to cause movement of its shuttle 102. In particular, subjecting the first and second leads 106*a*, 106*b* to a voltage causes the shuttle 102 to move from its first position and toward its second position due to the resulting electrostatic attraction between the shuttle 102 and the top portion 132 of the control portion 105, as follows. As discussed above, the shuttle 102 adjoins the beam portions 123 of the first, second, and third mounts 110*a*, 110*b*, 110*c*, so that the shuttle 102 is suspended from the mounts 110*a*, 110*b*, 110*c*. The beam portions 123 are in their neutral or un-deflected positions when the shuttle 102 is in its first position, as depicted in FIGS. 1, 5, and 7. Moreover, the shuttle 102 is electrically connected to the ground plane 26 by way of the first, second, and third mounts 110, 110*b*, 110*c*. The shuttle 102, including the fingers 104 thereof, thus remains in a grounded, or zero-potential state at all times.

Subjecting the first and second leads 106*a*, 106*b* of the first actuator 16*a* to a voltage potential results in energization of the fingers 138, as discussed above. The energized fingers 138 act as electrodes, e.g., an electric field is formed around each finger 138 due the voltage potential to which the finger 138 is being subjected. Each of the energized fingers 138 is positioned sufficiently close to its associated finger 104 on the grounded shuttle 102 so as to subject the associated finger 104 to the electrostatic force resulting from the electric field around the finger 138. The electrostatic force attracts the finger 104 to its corresponding finger 138.

The net electrostatic force acting on the six fingers 104 urges the shuttle 102 in the +y direction, toward its second or deflected position. The beam portions 123 of the first, second, and third mounts 110*a*, 110*b*, 110*c*, which were in their neutral or un-deflected state prior to energization of the fingers 138, are configured to deflect in response to the net force acting on the shuttle 102, thereby permitting the suspended shuttle 102 to move in the +y direction toward, or to its second position. The beam portion of the first mount 110*a* is depicted in a deflected condition in FIG. 8. The posts 120 also deflect to permit the noted movement of the shuttle 102.

The shuttle 102 will remain in a partially or fully deflected condition while the first actuator 16*a* remains subject to a voltage potential. The resilience of the beam portions 123 and the posts 120 will cause the shuttle 102 to return toward, or to its first or un-deflected position when the voltage potential is reduced or eliminated.

The relationship between the amount of deflection of the beam portions 123 and the voltage applied to the first actuator 16*a* is dependent upon the stiffness of the beam portions 123, which in turn is dependent upon factors that include the shape, length, and thickness of the beam portions 123, and the properties, e.g., Young's modulus, of the material from which the beam portions 123 are formed. These factors can be tailored to a particular application so as to minimize the required actuation voltage, while providing the beam portions 123 with sufficient strength for the particular application; with sufficient stiffness to tolerate the anticipated levels of shock and vibration; and with sufficient resilience to facilitate the return of the shuttle 102 to its first position when the voltage potential to the first actuator portion 16*a* is removed.

The first and second actuators 16*a*, 16*b* can be configured in a manner other than that described above in alternative embodiments. For example, suitable comb, plate, or other types of electrostatic actuators can be used in the alternative. Moreover, actuators other than electrostatic actuators, such as thermal, magnetic, and piezoelectric actuators, can be used in the alternative. In other alternative embodiments, a single actuator can be connected to, and can actuate both of the tuning elements 14*a*, 14*b*.

The first and second actuators tuning elements 14*a*, 14*b* are substantially identical. The following description of the functional characteristics of the first tuning element 14*a*, unless otherwise indicated, applies equally to the second tuning element 14*b*.

The movable portion 116 of the first tuning element 14*a* is disposed at an end of the body 103 of the shuttle 102, as discussed above. Movement of the shuttle 102 in the "y" direction thus imparts a corresponding movement to the movable portion 116. In particular, the movable portion 116 is movable in the "y" direction between a first or un-deflected position that corresponds to the first position of the shuttle 102, as depicted in FIG. 6A; and a second or deflected position that corresponds to the second position of the shuttle 102, as depicted in FIG. 6B. As can be seen from FIGS. 6A and 6B, movement of the movable portion 116 from its first to its second position causes an increase in the magnitude of the gap 119 between the dielectric element 50 and the end face 117 of the movable portion 116. The change in the magnitude of the gap 119 alters the frequency response of the coupler 12, as follows.

The first tuning element 14*a* comprises the projection 49*a*, the dielectric element 50, and the movable portion 116, as discussed above. The projection 49*a* adjoins the second leg 48 of the intermediate portion 32 of the coupler 12, and is thus subjected to the voltage potential associated with the input signal being transmitted through the coupler 12. The movable portion 116 adjoins the body 103 of the shuttle 102 of the first actuator 14*a*, and is thus maintained at a grounded, or zero-potential state.

The projection 49*a*, the dielectric element 50, the air with the gap 119, and the movable portion 116 function as a capacitive element when the coupler 12 is energized by the input signal thereto. In particular, the projection 49*a* and the movable portion 116 acts as the electrically-conductive plates of a capacitor, and the dielectric element 50 and the air within the gap 119 act as a dielectric located between the plates. The first and second tuning elements 14*a*, 14*b* thus introduce a source of reactance within the signal path through the coupler 12 when a sinusoidally-varying signal is input to the coupler 12 via the first leg 40 of the input portion 30.

The reactance of the first and second tuning elements 14*a*, 14*b* affects the resonance frequency of the coupler 12, which in turn varies the frequency response of the coupler 12. In particular, introducing the noted reactance into the coupler 12 causes the coupler 12 to act as a band-pass filter in which a band of frequencies at and near the resonance frequency of the coupler 12 pass through the coupler 12 with little or no attenuation, while frequencies outside of the pass band are substantially attenuated.

Moreover, the capacitance of the first and second tuning elements 14*a*, 14*b* can be varied as follows, which allows the pass band to be altered. Altering the pass band permits the coupler 12 to be "tuned" so as to facilitate the transmission of certain frequencies and the attenuation of others.

As discussed above, the first and second actuators 16*a*, 16*b* each operate the movable portion 116 of the first or second actuator 16*a*, 16*b* in the "y" direction, which in turn varies the gap 119 between the end face 117 of the movable portion 116 and the dielectric element 50. Increasing the gap 119 increases the amount of air between the end face 117 and the dielectric element 50. Increasing the gap (d) decreases the capacitance (C) of the first and second tuning elements 14*a*, 14*b*, which in turn increases the reactance (L/C) introduced into the signal path within the coupler 12 ($C=\in o*\in r*A/d$). The increase in reactance produces a corresponding increase in the resonant frequency (fo) of the coupler 12, which in turn increases the frequency of the pass band (fo=sqrt(L/C)). The coupler 12 can thus be tuned to respond maximally to an optimum or otherwise desired frequency or range of frequencies at a particular operating condition.

The optimal number of tuning elements 14*a*, 14*b* for the system 10 is application-dependent, and can vary with factors such as the desired or required level of reactance to be introduced into the signal path within the coupler 12; size constraints imposed on tuning elements; etc. Alternative embodiments of the system 10 can be formed with more, or less than two of the tuning elements 14*a*, 14*b*.

The system 10 can be equipped with a controller (not shown) configured to control the movement of the movable portions 116 of the first and second tuning elements 14*a*, 14*b* so as to produce a desired tuning effect in the coupler 12 at a particular operating condition.

Based on finite element modeling (FEM), it is estimated the system 10 has a tuning range of approximately 3.6 (GHz) with a center frequency of approximately 42.4 GHz, and with very favorable return losses of 42.5 (dB). Moreover, the substantially all-metal construction of the coupler 12 gives the coupler 12 relatively high power-handling capability, while permitting the coupler 12 to be constructed within a relatively small dimensional footprint.

The system 10 and alternative embodiments thereof can be manufactured using known processing techniques for creating three-dimensional microstructures, including coaxial transmission lines. For example, the processing methods described in U.S. Pat. Nos. 7,898,356 and 7,012,489, the disclosure of which is incorporated herein by reference, can be adapted and applied to the manufacture of the switch 10 and alternative embodiments thereof.

The system 10 can be manufactured using the following process. A layer of photoresist material is selectively applied to the upper surface of the substrate 18 so that the only exposed portions of the upper surface correspond to the locations of the various components of the system 10 that are to be disposed directly on the substrate 18. The electrically-conductive material, i.e., Cu, is subsequently deposited on the exposed portions of the substrate 18 to a predetermined thickness, to form the first layer of the electrically-conductive material.

Another photoresist layer is subsequently applied to the partially-constructed system 10 by patterning additional photoresist material over the partially-constructed system 10, and over the previously-applied photoresist layer, so that so that the only exposed areas on the partially-constructed system 10 correspond to the locations at which the various portions of the second layer of the system 10 are to be located. The electrically-conductive material is subsequently deposited on the exposed portions of the system 10 to a predetermined thickness, to form the second layer of the electrically-conductive material. The third through fifth layers are subsequently formed in substantially the same manner. Once the fifth layer has been formed, the photoresist material remaining from each of the masking steps can be released or otherwise removed, using a suitable technique such as exposure to an appropriate solvent that dissolves the photoresist material.

An adaptation of the above process to the manufacture of a microelectromechanical systems (MEMS) switch is described in detail in co-pending U.S. application Ser. No. 13/592,435 filed on Aug. 23, 2012, the contents of which is incorporated by reference herein in its entirety.

What is claimed is:

1. A coupler system, comprising:
a coupler comprising an electrical conductor;
a tuning element comprising:
an electrically-conductive first portion connected directly to the electrical conductor of the coupler so as to be in direct electrical contact therewith and having a first end face;
an electrically-conductive second portion having a second end face; and
a dielectric element disposed on one of the first and second end faces and being spaced apart from the other of the first and second end faces by a gap;
wherein the electrically-conductive second portion is moveable in relation to the electrically-conductive first portion so that the gap is variable.

2. The system of claim 1, wherein the coupler is configured to split an input signal into two output signals, and to combine two input signals into a single output signal.

3. The system of claim 1, wherein the tuning element is a capacitive element that alters a frequency response of the coupler.

4. The system of claim 3, wherein the frequency response of the coupler varies with a magnitude of the gap between the dielectric element and the second end face of the electrically-conductive second portion.

5. The system of claim 1, further comprising an actuator configured to move the electrically-conductive second portion of the tuning element.

6. The system of claim 5, further comprising a substrate, and an electrically-conductive control portion mounted on the substrate.

7. The system of claim 6, wherein the actuator comprises a shuttle having the electrically-conductive second portion of the tuning element disposed thereon, and a body operative to generate a force that moves the shuttle and the electrically-conductive second portion of the tuning element in relation to the electrically-conductive first portion of the tuning element.

8. The system of claim 1, wherein the dielectric element is a dielectric film.

9. A coupler system, comprising:
a coupler comprising an electrical conductor;
a tuning element comprising:

an electrically-conductive first portion in electrical contact with the electrical conductor of the coupler and having a first end face;

an electrically-conductive second portion having a second end face; and a dielectric element disposed on one of the first and second end faces and being spaced apart from the other of the first and second end faces by a gap;

wherein the electrically-conductive second portion is moveable in relation to the first portion so that the gap is variable; and wherein the electrically-conductive first portion of the tuning element comprises a projection that adjoins the electrical conductor of the coupler.

10. The system of claim 9, wherein the electrical conductor of the coupler comprises:

an input portion having a first leg and a second leg which are substantially identical and that each extend substantially in a first direction;

an intermediate input portion having:

a first intermediate leg and a second intermediate leg which are substantially identical and that each extend substantially in the first direction; and a third intermediate leg and a fourth intermediate leg which are substantially identical and that each extend substantially in a second direction substantially perpendicular to the first direction;

wherein:

the first intermediate leg of the intermediate input portion adjoins the first leg of the input portion;

the second intermediate leg of the intermediate input portion adjoins the second leg of the input portion;

the third and fourth intermediate legs of the intermediate input portion adjoin the first and second intermediate legs of the intermediate input portion; and the first portion of the tuning element adjoins the second intermediate leg of the intermediate input portion; and an output portion having a first output leg and a second output leg that are substantially identical and that each extend substantially in the first direction, wherein the first output leg of the output portion adjoins the first intermediate leg of the intermediate input portion, and the second output leg of the output portion adjoins the second intermediate leg of the intermediate input portion.

11. The system of claim 10, wherein the projection of the tuning element adjoins the second intermediate leg of the intermediate input portion.

12. A coupler system, comprising:

a coupler comprising an electrical conductor;

a tuning element comprising:

an electrically-conductive first portion that adjoins the electrical conductor of the coupler so as to be in electrical contact therewith and having a first end face;

an electrically-conductive second portion having a second end face; and a dielectric element disposed on one of the first and second end faces and being spaced apart from the other of the first and second end faces by a gap;

an actuator configured to move the electrically-conductive second portion of the tuning element; and a substrate, and an electrically-conductive control portion mounted on the substrate;

wherein the electrically-conductive second portion is moveable in relation to the electrically-conductive first portion so that the gap is variable;

wherein the actuator comprises a shuttle having the electrically-conductive second portion of the tuning element disposed thereon, and a body operative to generate a force that moves the shuttle and the electrically-conductive second portion of the tuning element in relation to the electrically-conductive first portion of the tuning element; and wherein:

the body comprises a first and second leg disposed on the substrate, and a top portion mounted on the first and second legs and including a first projection;

the shuttle comprises a second projection that adjoins the body and is located proximate the first projection; and the first projection of the top portion, when subjected to a voltage potential, is operative to develop an electrostatic force that attracts the second projection of the shuttle and thereby urges the shuttle and the electrically-conductive second portion of the tuning element toward the electrically-conductive first portion of the tuning element.

13. A coupler system, comprising:

a coupler comprising an electrical conductor;

a tuning element comprising:

an electrically-conductive first portion that adjoins the electrical conductor of the coupler so as to be in electrical contact therewith and having a first end face;

an electrically-conductive second portion having a second end face; and a dielectric element disposed on one of the first and second end faces and being spaced apart from the other of the first and second end faces by a gap;

an actuator configured to move the electrically-conductive second portion of the tuning element;

a substrate, and an electrically-conductive control portion mounted on the substrate; and a plurality of tabs each comprising a dielectric material, wherein the electrical conductor of the coupler is suspended within a housing on the plurality of tabs;

wherein the electrically-conductive second portion is moveable in relation to the electrically-conductive first portion so that the gap is variable.

14. A system, comprising:

a coupler comprising an electrically-conductive housing and an electrical conductor, wherein the electrical conductor is suspended within the electrically-conductive housing on a plurality of dielectric tabs and is spaced apart from the electrically-conductive housing; and a capacitive element configured to vary a frequency response of the coupler, the capacitive element comprising an electrically-conductive first portion that is connected directly to the electrical conductor of the coupler so as to be in direct electrical contact therewith.

15. The system of claim 14, wherein the coupler is configured to split an input signal into two output signals, and to combine two input signals into a single output signal.

16. The system of claim 14, wherein:

the electrically-conductive first portion has a first end face;

the capacitive element further comprises an electrically-conductive second portion having a second end face; and a dielectric element is disposed on one of the first and second end faces and spaced apart from the other of the first and second end faces by a gap.

17. The system of claim 16, wherein the electrically-conductive second portion of the capacitive element is moveable in relation to the dielectric element.

18. The system of claim 17, further comprising an actuator operative to move the electrically-conductive second portion of the capacitive element in relation to the dielectric element.

19. The system of claim 16, wherein the dielectric element is a dielectric film.

20. A system, comprising:

a coupler comprising an electrically-conductive housing and an electrical conductor, wherein the electrical conductor is suspended within the electrically-conductive housing on a plurality of dielectric tabs and is spaced apart from the electrically-conductive housing; and a capacitive element configured to vary a frequency response of the coupler;

wherein the capacitive element comprises:

an electrically-conductive first portion in electrical contact with the electrical conductor of the coupler and having a first end face;

an electrically-conductive second portion having a second end face; and a dielectric element disposed on one of the first and second end faces and being spaced apart from the other of the first and second end faces by a gap; and wherein the electrically-conductive first portion of the capacitive element comprises a projection that adjoins the electrical conductor of the coupler.

21. The system of claim 20, wherein the electrical conductor of the coupler comprises:

an input portion having a first leg and a second leg that are substantially identical and that each extend substantially in a first direction;

an intermediate input portion having:

a first intermediate leg and a second intermediate leg that are substantially identical and that each extend substantially in the first direction; and a third intermediate leg and a fourth intermediate leg that are substantially identical and that each extend substantially in a second direction substantially perpendicular to the first direction;

wherein:

the first intermediate leg of the intermediate input portion adjoins the first leg of the input portion;

the second intermediate leg of the intermediate input portion adjoins the second leg of the input portion;

the third and fourth intermediate legs of the intermediate input portion adjoin the first and second intermediate legs of the intermediate input portion; and the first portion of the tuning element adjoins the second intermediate leg of the intermediate input portion; and an output portion having a first output leg and a second output leg that are substantially identical and that each extend substantially in the first direction, wherein the first output leg of the output portion adjoins the first intermediate leg of the intermediate input portion, and the second output leg of the output portion adjoins the second intermediate leg of the intermediate input portion.

22. The system of claim 21, wherein the projection of the capacitive element adjoins the second intermediate leg of the intermediate input portion.

23. A system comprising:

a coupler comprising an electrical conductor that forms a signal path;

a capacitive element introducing a reactance in the signal path when a capacitance thereof is varied, said capacitive element having spaced apart first and second electrically-conductive portions, where the first electrically-conductive portion is connected directly to the electrical conductor of the coupler so as to be in direct electrical contact therewith; and an actuator element operative to vary the capacitance of the capacitive element.

24. The system of claim 23, wherein:

the first electrically-conductive portion has a first end face;

the second electrically-conductive portion has a second end face;

a dielectric element is disposed on one of the first and second end faces and spaced apart from the other of the first and second end faces by a gap; and the actuator is operative to move the second electrically-conductive portion in relation to the first electrically-conductive portion to vary the gap.

* * * * *